US008070077B2

(12) United States Patent
de Leeuw

(10) Patent No.: US 8,070,077 B2
(45) Date of Patent: Dec. 6, 2011

(54) APPARATUS FOR DISPENSING LIQUID MATERIAL

(75) Inventor: Victor de Leeuw, Hilvarenbeek (NL)

(73) Assignee: Nordson Corporation, Westlake, OH (US)

( * ) Notice: Subject to any disclaimer, the term of this patent is extended or adjusted under 35 U.S.C. 154(b) by 942 days.

(21) Appl. No.: 11/965,328

(22) Filed: Dec. 27, 2007

(65) Prior Publication Data

US 2008/0179352 A1 Jul. 31, 2008

(30) Foreign Application Priority Data

Jan. 25, 2007 (EP) ..... 07101208

(51) Int. Cl.
*B05B 5/00* (2006.01)

(52) U.S. Cl. ..... 239/690.1; 239/690

(58) Field of Classification Search ..... 222/1, 146.2, 222/146.5, 504, 309, 340; 239/585.1, 333, 239/337, 349, 359, 690, 690.1
See application file for complete search history.

(56) References Cited

U.S. PATENT DOCUMENTS 3,043,336 A 7/1962 Parent et al.
4,962,871 A 10/1990 Reeves
6,481,596 B1 * 11/2002 Rusnak ..... 222/1
7,156,261 B2 * 1/2007 Saidman et al. ..... 222/146.5
2004/0195278 A1 10/2004 Leeuw

FOREIGN PATENT DOCUMENTS

| | | | |
|---|---|---|---|
| DE | 3841474 | A1 | 6/1990 |
| EP | 0711943 | A2 | 5/1996 |
| EP | 0908240 | A2 | 4/1999 |
| EP | 1123752 | A2 | 8/2001 |
| FR | 2498002 | A1 | 7/1982 |
| WO | 99/60262 | A1 | 11/1999 |

OTHER PUBLICATIONS

European Patent Office, European Search Report in EP Application No. 07101208, Jul. 5, 2007.

* cited by examiner

*Primary Examiner* — Davis Hwu
(74) *Attorney, Agent, or Firm* — Wood, Herron & Evans, L.L.P.

(57) ABSTRACT

A method and an apparatus for dispensing liquid material to a substrate comprising a housing having a bore and an inlet for supplying liquid material from a material source to the bore. A nozzle communicates with the inlet and includes a discharge opening for dispensing the liquid material. A movable plunger is mounted for reciprocal movement between a closed and an open position. In the open position, liquid material is dispensed from the discharge opening and in the closed position, liquid material is prevented from being dispensed from the discharge opening. An actuator moves the plunger between the closed and the open position. The plunger has at least one slot extending from the outer periphery toward the center of the plunger.

25 Claims, 4 Drawing Sheets

APPARATUS FOR DISPENSING LIQUID MATERIAL

The present application claims the priority of European Patent Application No. 07101208.2 filed Jan. 25, 2007 under 35 U.S.C. §119. The disclosure of that priority application is hereby fully incorporated by reference herein.

TECHNICAL FIELD

The present invention generally relates to apparatus and methods for dispensing liquid materials such as adhesives or sealants.

BACKGROUND

Various fluid dispensers include movable valve elements, such as valve stems, for allowing and preventing fluid flow from the dispenser. Electromagnetically actuated dispensing apparatus, also known as electric guns, include a magnetic pole piece, a magnetic plunger or armature, a valve stem coupled for movement with the armature and an electromagnetic coil which is part of the actuation means for moving the plunger. The armature can be moved relative to the pole piece by selectively energizing and de-energizing the electromagnetic coil. The movement of the plunger or armature towards the pole piece disengages the valve stem from a valve seat and opens the dispensing module. When the electromagnetic coil is de-energized, a biasing means, preferably a return spring, forces the armature away from the pole piece. The valve stem is urged into contact with the valve seat to close the module. Such modules are known from U.S. Pat. No. 6,994,234 or EP 0908240, owned by the present applicant.

The frequency of the reciprocating movement of the plunger is referred to as cycle rate. The cycle rate has an influence on the shape of the material dispensed on a substrate. In order to improve the cycle rate, at least one flux guide element is conventionally employed in order to strengthen the magnetic field by improving the magnetic flux. These flux guide elements can be tubular structures surrounding the plunger, the electromagnetic coil and/or the pole piece and can be formed of the housing. During operation, eddy currents can be generated within the flux guide elements, which can decrease the cycle rate. Circumferential electrical currents retard the dissipation of the magnetic field. In order to reduce such eddy currents, U.S. Pat. No. 6,994,234 suggests a gap in a flux guide element which is formed by the housing.

However, there is a need to further improve the performance characteristics, in particular the cycle rate of a fluid dispensing apparatus capable of operating and high frequencies. Thus, it is the object of the invention to provide an improved liquid dispensing apparatus.

SUMMARY

According to one aspect of the invention, a dispensing apparatus includes a plunger which has at least one slot extending from the outer periphery toward the center of the plunger. The slot or gap within the plunger further improves the performance characteristics such as the cycle rate by avoiding eddy currents within the plunger. The slot extends essentially from the outer periphery to an inner portion of the plunger. The slot may extend to essentially the center of the plunger or to an inner bore within the plunger. The slot or gap thus results in an interruption of eddy currents within the plunger, so that upon de-energisation of the actuation means the plunger is moved faster into the closed position.

According to another aspect, a pole piece comprises at least one slot which extends from the outer periphery toward the center of the pole piece. A slot which extends from the outer peripheral surface substantially towards the center of the pole piece further improves the performance characteristics such as the cycle rate of the apparatus. The reason for this improvement is essentially the same as explained above with reference to a slotted plunger or armature. The magnetic fields within the flux guiding elements can be reduced quicker by substantially avoiding eddy currents which would occur during the de-energisation of the coil. The cycle rates are optimized if both the plunger and pole piece comprise at least one slot for reducing eddy currents. Further, the dispenser or module is improved if a housing associated with the dispenser has at least one slot extending from the outer periphery thereof toward the center of the housing.

The slot for reducing eddy currents is particularly effective if it extends over the entire length of the pole piece and/or the plunger and/or the housing, respectively.

In yet another preferred embodiment, the slots of the plunger, the housing and the pole piece are axially aligned with one another.

According to another preferred embodiment, the plunger has a stepped diameter defining a first portion of a first diameter and a first end surface, a second portion of a reduced diameter and that the slot extends essentially along the first and second portion.

Preferably, the plunger has a third portion with further reduced diameter, the first and the second portion containing a concentric bore and at least one angled flow channel intersecting with the bore. The fluid dynamics within the apparatus are further substantially improved in this way, since fluid material can flow within the bores and flow channels during the movement of the plunger. The characteristics are further improved if the plunger includes at least one groove on the outer surface of the first portion of the plunger. Such groove only has a relatively small depth such that it is not particularly effective for reducing eddy currents but is effective with regards to the liquid flow characteristics and an improved plunger movement.

In another preferred embodiment, the plunger comprises means for generating a magnetic field for the selected movement of the plunger. A biasing means can be formed by a spring which biases the plunger into the closed position and the valve stem into contact with the valve seat.

In another preferred embodiment, a sleeve member is provided within the housing and is effective for guiding the moveable plunger to perform a linear reciprocating movement. Preferably, the sleeve member is attached to a first manifold which is attached to an upper end of the housing and has an inlet for supplying liquid material into the housing. The sleeve member may comprise a slot extending in axial direction. This slot further improves the cycle rate.

An illustrative apparatus is described in more detail with reference to the accompanied drawings as briefly described below.

DETAILED DESCRIPTION

For the purpose of the present discussion, the method and apparatus of this invention is described in connection with dispensing liquid material. Such materials include hot melt polymeric materials used in adhesive applications. Hot melt materials are usually solid at room temperature but convert into a liquid state when heated. It should be understood that the methods and apparatus of this invention are believed to be equally applicable for use in connection with the dispensing of other heated fluid materials, such as waxes, as well as those adhesives which are normally a liquid at room or ambient temperature and therefore do not require heating and are sometimes referred to as cold glue.

The following definitions are applicable to this specification, including the claims, wherein "Axial" and "Axially" are used herein to refer to lines or directions that are generally parallel to the axis of reciprocal motion of the plunger of the dispenser. "Radial" and "Radially" are used to mean directions radially toward or away from the axis of motion of the plunger. Within the following description of the drawings it is understood that the flow of the material enters the inlet and leaves via the discharge opening. The position of the parts relative to each other are, where applicable, related to the direction of the flow.

Figure 1:
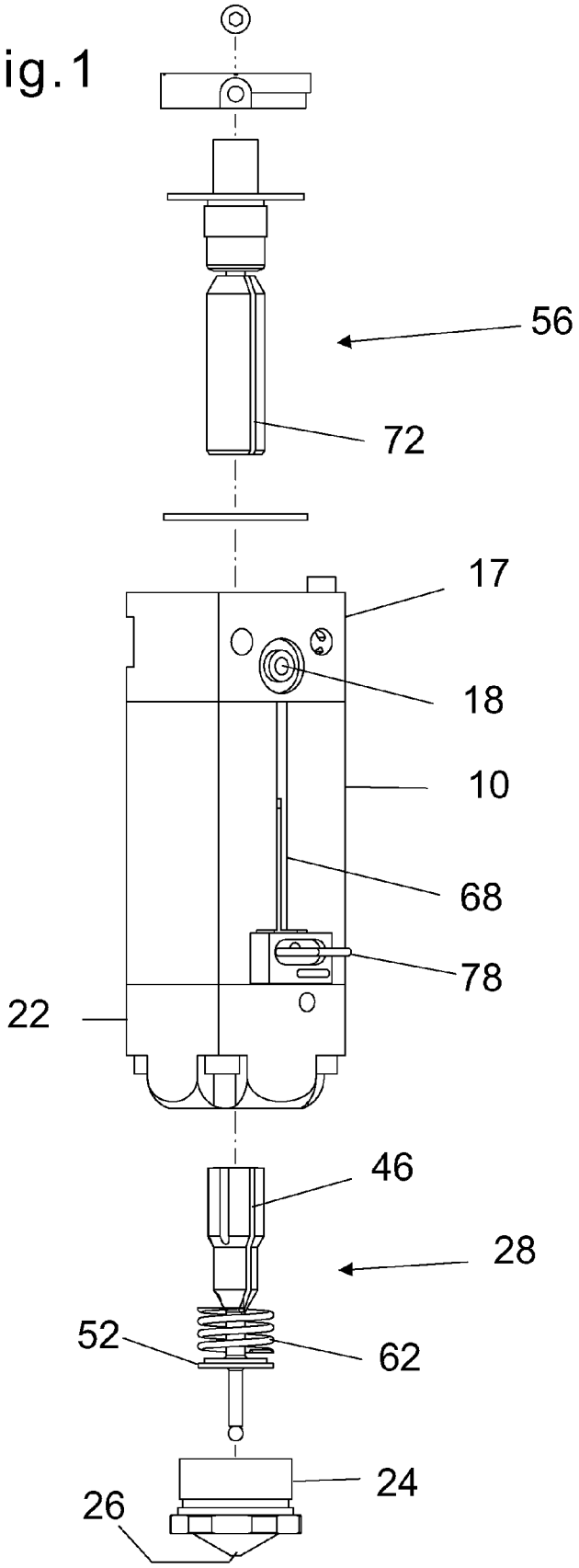
FIG. 1 is an exploded perspective view of the apparatus.

FIG. 1 illustrates a housing 10 forming the central part of the apparatus. A first manifold 17 is arranged adjacent to the housing 10 in upstream direction of the flow and contains inlet 18 which is connectable to a material source (not shown) for the supply of liquid material. In downstream direction, a second manifold 22 follows the housing 10. The lower manifold 22 comprises an internal bore 76 and means for receiving nozzle 24 in which discharge opening 26 is integrated. The plunger 28 and pole piece 56 can be inserted into the first and second manifolds 17, 22 as well as into the housing 10. The plunger 28 is provided with spring 62 for biasing the plunger 28 into a position in which the flow of the liquid material is interrupted.

The pole piece 56 includes a slot 72. The housing 10 includes a slot 68, and the plunger 28 includes a slot 46. All the slots are axially aligned to each other after assembly. However, different alignments are also possible and within the scope of this invention.

Figure 2:
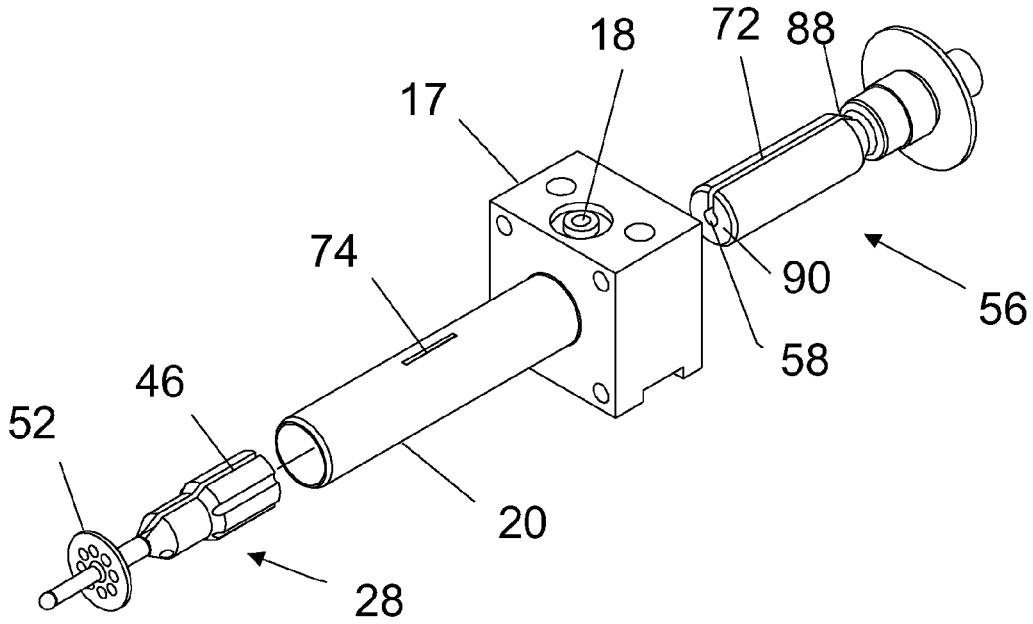
FIG. 2 is an exploded perspective view of the plunger, the first manifold and the pole piece.

With reference to FIG. 2 the first manifold 17 is shown in an enlarged exploded view together with the plunger 28 and the pole piece 56. The first manifold 17 comprises sleeve member 20 into which the plunger 28 as well as the pole piece 56 are introducible to guide the plunger 28 and the pole piece 56. Within the sleeve member 20, the plunger 28 is mounted for reciprocal movement. The pole piece 56 comprises an end surface 90, a recess 88 and a bore 58 which intersects with the slot 72. Via the recess 88, the bore 58 is in fluid communication with the inlet 18. The sleeve member 20 further comprises a slot 74 on its outer surface extending through its entire wall. The slot 74 only partially extends in axial direction over the length of the sleeve member 20. However, other extensions of the slot 74 are also possible. The slot 74 is axially aligned with the slot 46 of the plunger 20, the slot 68 of the housing 10 and slot 72 of the pole piece 56.

Figure 3:
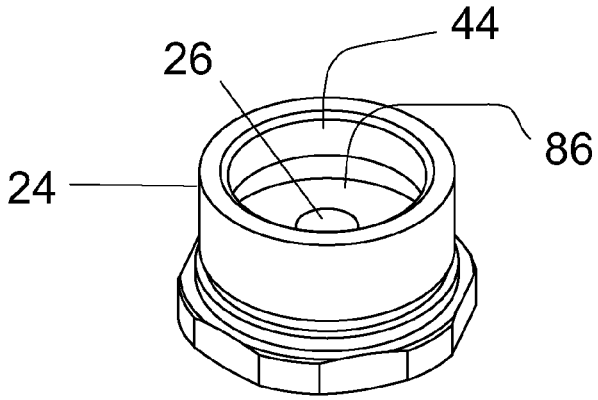
FIG. 3 is a perspective view of the nozzle.

FIG. 3 illustrates an enlarged view of the nozzle 24. The nozzle 24 contains means for being received by and connected to the second manifold 22, e.g. threads. Furthermore, the nozzle 24 comprises a flow chamber 44 in which protrusions 52 of the plunger 28 can be inserted. In downstream direction, the flow channel enters into valve seat 86. It essentially consists of a conically tapering section within the nozzle 24. Further, the nozzle 24 forms the discharge opening 26 through which the liquid material leaves the apparatus and can be applied to a substrate.

Figure 4A:
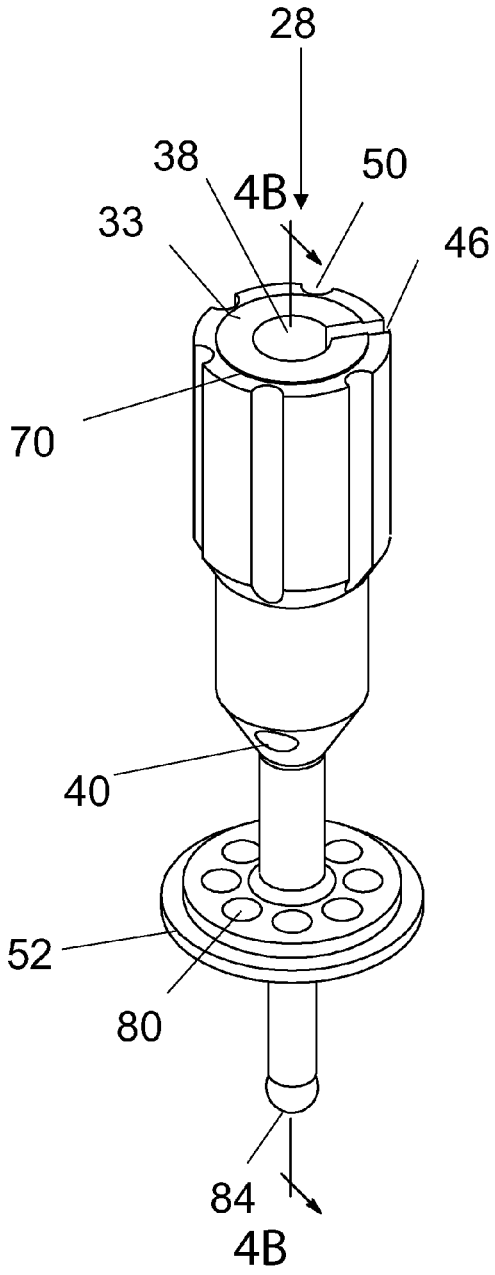
FIG. 4A is a perspective view of the plunger.
Figure 4B:
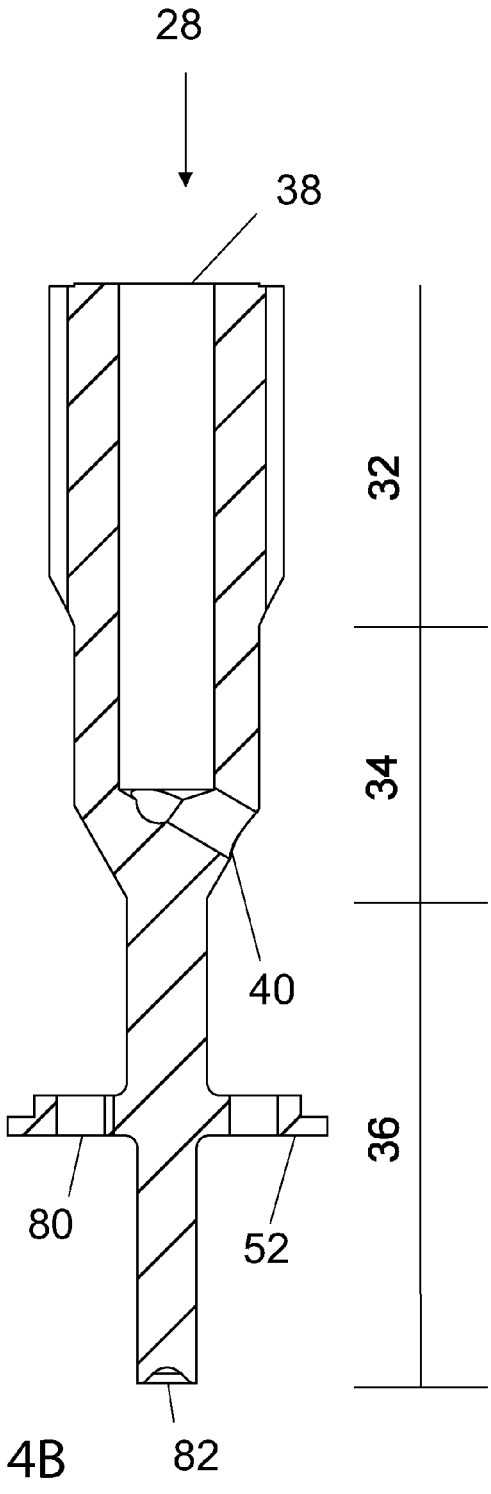
FIG. 4B is a cross sectional view of the plunger taken generally along the lengthwise or longitudinal axis 4B-4B thereof as shown in FIG. 4A.

Referring to FIGS. 4A and 4B, detailed views of the plunger 28 are given. The plunger 28 is subdivided into three portions 32, 34 and 36 and has an end surface 33 which contains crank 70. The three portions 32, 34 and 36 have different diameters. In the shown embodiment, the first portion 32 has the biggest, the second portion 34 a reduced diameter relative to the first portion, and the third portion 36 an further reduced diameter. The diameter of the first portion closely approximates that of the inner diameter of the sleeve member 20. This helps to keep the plunger 28 properly aligned as it slides back and forth. While a close fit provides for proper guiding of the plunger 28, it does not provide an optimum flow path for the material. Therefore, in order to help the fluid material to flow past the first portion 32 grooves 50 extend axially along the outer periphery. Causing the fluid to flow past the plunger 28 in this manner helps to prevent dead spots from occurring in the flow of the liquid material through the dispenser, as well as helping to reduce the force required to move the plunger 28 back and forth. With dead spots, the liquid material may begin to oxidize to produce undesirable particles or chunks, commonly known as char. Preferably, the grooves 50 have a semicircular cross-section. Having a semi-circular cross-section provides for better magnetic efficiency and improved fluid flow over a straight sided slot. It is understood that the grooves 50 can have different arrangements and cross sections within the scope of this invention.

A concentrical bore 38 extends through the first and second portion 32, 34. Further, the plunger 28 comprises at least one angled flow channel 40 which intersects with the bore 38. The slot 46 extends over the entire length of the bore 38, spreading over the first and second portion 32, 34 of the plunger 28. The protrusions 52 contain at least one through hole 80 arranged in axial direction. The protrusions 52 for receiving the biasing means such as the spring 62 are arranged on the third portion 36 of the plunger 28. The third portion 36 of the plunger 28 also includes a socket 82 for receiving a ball end 84. The spring 62 provides a biasing force for urging the ball 84 into engagement with the seat 86 to prevent the flow of material from the discharge outlet 26.

Figure 5A:
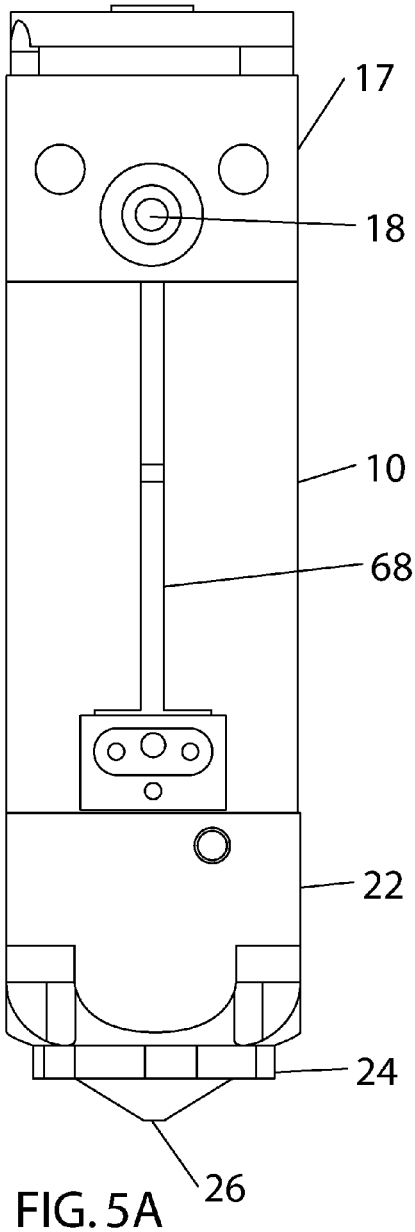
FIG. 5A is a front elevational view of the housing and the first and second manifold.
Figure 5B:
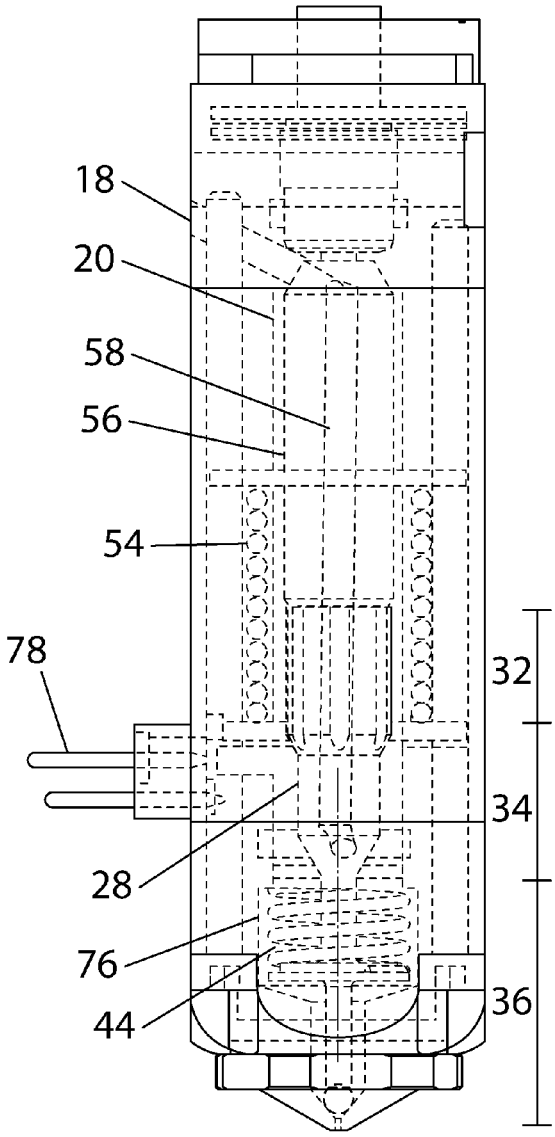
FIG. 5B is a side elevational view taken generally longitudinally and illustrating the housing and the first and second manifold, as well as certain internal components in dashed lines.

FIGS. 5A and 5B show the apparatus in its assembled configuration. Within the housing 10, electrical coils 54 are arranged which can be energised via a power supply 78.

During assembly, the pole piece 56 is introduced into the sleeve member 20 of the first manifold 17 (see FIG. 2) and tightly connected by appropriate means (not shown). Subsequently, the first manifold 17 is introduced into the housing 10, the latter carrying the coils 54. The spring 62 is placed over the plunger 28 such that it abuts against the protrusions 52. The plunger 28 is pushed into the sleeve member 20 until the spring 62 abuts against the housing 10. The nozzle 24 is attached to the lower manifold 22. The first manifold 17, the housing 10 and the second manifold 22 are now attached to each other, e.g. by screws (not shown).

The liquid material enters into the apparatus via the inlet 18 and further continues into the recess 88 of the pole piece 56 (FIG. 2). The recess 88 is in fluid communication with the bore 58 and the slot 72 of the pole piece 56. Accordingly, the liquid material is further directed through the pole piece 56 until it reaches the lower end surface 90.

In the closed position of the plunger 28 a small intermediate space is formed where the liquid can partially accumulate. The liquid further flows via the grooves 50 and/or the bore 38 and flow channel 40 via the holes 80 of the protrusion 52 into the flow chamber 44. The flow continues until all the available space within the apparatus is taken up by the liquid material.

In the open position of the plunger 28 the end surface 33 abuts against the end surface 90 of the pole piece 56 such that the flow via the grooves 50 is at least reduced. The main part of the liquid material is now flowing via the bore 38 and the flow channel 40 and further into the flow channel 44 as described above. Since the plunger 28 is now in the open position, the flow further continues through the discharge opening 26 where it leaves the dispensing apparatus.

Operation of the Dispensing Apparatus

When the coil 54 is energised, the generated magnetic field will induce an electromagnetic field which will cause the plunger 28 to be attracted to pole piece 56. This force will be sufficient to overcome the force of the spring 62 thereby drawing the end surface 33 of the plunger 28 towards the lower end surface 90 of pole piece 56. This in turn causes the ball 84 to be spaced from the valve seat 86 thereby causing a fluid flow from the fluid chamber 44 to the discharge opening 26. This allows the liquid material to be dispensed from the discharge opening 26. When the coil is de-energised, the field collapses and the plunger 28 will be moved back to the closed position by the spring 62.

Since it is desirable for many applications that the liquid material is dispensed within short intervals, the reciprocal movement of the plunger 28 has to be conducted as quickly as possible. This requires that the electromagnetic field is generated but also decomposed as quickly as possible. The decomposition of the magnetic field has been found to be the limiting step in realizing dispensing cycles of short intervals. The aligned slots 46, 68, 72 and 74 of the plunger 28, the housing 10, the pole piece 56 and the sleeve member 20, respectively, serve for the accelerated decomposition of the magnetic field, thereby enabling shorter dispensing cycles.

When dispensing, the end surface 33 of the first portion 32 of the plunger 28 will be adjacent to and/or in contact with the end surface 90 of the pole piece 56. Liquid material trapped between the end surface 33 of the plunger 28 and the end surface 90 of the pole piece 56 will contribute to an increase in the force required to begin to move the plunger 28 to the closed position and/or will cause the closing response time to increase. This phenomenon is similar to the increase in force that is required to separate two pieces of glass which have a drop of fluid placed in between them.

The crank 70 on the end surface 33 of the plunger 28 serves to reduce the contact area between the end surface 33 and the end surface 90 of the pole piece 56 such that the force required to move the plunger 28 to the closed position is reduced. At the same time, the closing response time of the plunger upon decomposition of the magnetic field will decrease.

As the plunger moves from the closed to the open position, there is fluid between the end surface 33 of the plunger 28 and the pole piece 56 which must be displaced. The end surface 33, acting much like a piston, will displace the liquid material through the grooves 50, as well as through the bore 38 and the flow channel 40, and into the fluid chamber 44. This arrangement further helps in decreasing the response time necessary to move the plunger 28 to the open position.

While the present invention has been illustrated by a description of various embodiments and while these embodiments have been described in some detail, it is not the intention of the Applicant to restrict or in any way limit the scope of the appended claims to such detail. Additional advantages and modifications will readily appear to those skilled in the art. The various features disclosed herein may be used alone or in any combination depending on the needs and preferences of the user. The invention itself should only be defined by the appended claims.

What is claimed is:

1. An apparatus for dispensing liquid material to a substrate comprising:

a housing having a bore and an inlet for supplying liquid material from a material source to the bore, a nozzle coupled to the housing and communicating with the inlet, the nozzle having a discharge opening for dispensing the liquid material, a movable plunger including an outer periphery, an axial center located radially inwardly from the outer periphery, a valve element, and at least one slot extending from the outer periphery to the center of the plunger, the plunger being mounted for reciprocal movement between a closed and an open position, wherein in the open position, liquid material is dispensed from the discharge opening and in the closed position, the valve element blocks liquid material from being dispensed from the discharge opening, and an actuator for moving the plunger between the closed position and the open position, wherein the at least one slot in the plunger dissipates electromagnetic eddy currents formed by operation of the actuator.

2. The apparatus of claim 1, wherein the actuator includes a pole piece which has a center, an outer periphery, and at least one slot extending from the outer periphery of the pole piece toward the center of the pole piece.

3. The apparatus of claim 2, wherein the housing has a center, an outer periphery, and at least one slot extending from the outer periphery of the housing toward the center of the housing.

4. The apparatus of claim 3, wherein the at least one slot in the pole piece extends over an entire length of the pole piece.

5. The apparatus of claim 3, wherein the at least one slot in the housing extends over an entire length of the housing.

6. The apparatus of claim 3, characterised in that the slots of the plunger, the housing, and the pole piece are axially aligned.

7. The apparatus of claim 3, further comprising:

a first manifold arranged upstream and adjacent to the housing.

8. The apparatus of claim 7, wherein the first manifold includes the inlet and a sleeve member extending through the bore of the housing and communicating with the inlet.

9. The apparatus of claim 8, wherein the pole piece is inserted into the sleeve member of the first manifold.

10. The apparatus of claim 9, wherein the sleeve member further includes a slot located on an outer periphery of the sleeve member and fully extending through the sleeve member.

11. The apparatus of claim 10, wherein the slot in the sleeve member extends along an axial direction of the sleeve member and is aligned with the slots of the plunger, the housing, and the pole piece.

12. The apparatus of claim 8, wherein at least a first portion of the plunger is at least partially arranged inside the sleeve member.

13. The apparatus of claim 8, further comprising:

a second manifold arranged downstream and adjacent to the housing.

14. The apparatus of claim 13, wherein the second manifold includes means for receiving the nozzle and a bore in communication with the sleeve member and the discharge opening.

15. The apparatus of claim 2, wherein the pole piece includes a bore which is in fluid communication with the inlet.

16. The apparatus of claim 1, wherein the plunger has a stepped diameter defining a first portion with a first diameter and a first end surface, and a second portion with a second diameter less than the first diameter, and wherein the slot in the plunger extends along the first and second portion.

17. The apparatus of claim 16, wherein the plunger has a third portion with a third diameter less than the second diameter, the first portion and the second portion containing a concentric bore communicating with the slot in the plunger and at least one angled flow channel intersecting with the concentric bore.

18. The apparatus of claim 17, wherein the plunger further includes protrusions arranged on the third portion of the plunger, and the apparatus further comprises:

biasing means engaging the protrusions for biasing the plunger into the closed position.

19. The apparatus of claim 16, wherein the plunger includes at least one groove on an outer surface of the first portion.

20. The apparatus of claim 19, wherein the at least one groove defines a semi-circular cross-section.

21. The apparatus of claim 16, wherein the first end surface of the plunger has a crank.

22. The apparatus of claim 1, wherein the actuator includes means for generating a magnetic field for the selected movement of the plunger.

23. The apparatus of claim 22, wherein the means for generating a magnetic field comprise at least one electrical coil.

24. The apparatus of claim 23, wherein the electrical coils are located within the housing.

25. A method for dispensing liquid material such as hot melt adhesives to a substrate with an apparatus including a housing with a bore and an inlet, a nozzle including a discharge opening, an actuator, and a movable plunger located within the housing and including an outer periphery, an axial center located radially inwardly from the outer periphery, a valve element, and at least one slot extending from the outer periphery to the center, the method comprising:

directing a flow of liquid material to the inlet, directing the flow through the bore to the nozzle, holding the plunger in a closed position by biasing means such that the valve element blocks flow of the liquid material through the discharge opening, generating a magnetic field with the actuator, thereby causing movement of the plunger from the closed into an open position in which the valve element does not prevent flow of the liquid material through the discharge opening, and directing the flow of liquid material through the at least one slot in the plunger to dissipate electromagnetic eddy currents formed during operation of the actuator.

* * * * *